United States Patent [19]

O'Brien, Jr. et al.

[11] Patent Number: 4,487,738

[45] Date of Patent: Dec. 11, 1984

[54] METHOD OF PRODUCING $^{67}$CU

[75] Inventors: Harold A. O'Brien, Jr.; John W. Barnes; Wayne A. Taylor; Kenneth E. Thomas; Glenn E. Bentley, all of Los Alamos, N. Mex.

[73] Assignee: The United States of America as represented by the United States Department of Energy, Washington, D.C.

[21] Appl. No.: 477,459

[22] Filed: Mar. 21, 1983

[51] Int. Cl.$^3$ ..... G21G 1/10

[52] U.S. Cl. ..... 376/192; 376/194; 376/195; 423/24; 210/263

[58] Field of Search ..... 376/157, 192, 194, 195; 423/24; 210/263, 268

[56] References Cited

U.S. PATENT DOCUMENTS 3,957,945 5/1976 Grant ..... 376/192
4,360,495 11/1982 Bauer ..... 376/192

OTHER PUBLICATIONS

C. J. Orth, "Interlaboratory Comparison of Spallation–Reaction Cross Sections for Iron and Copper with 590 MeV Protons", Journal of Inorganic & Nuclear Chemistry, vol. 38, No. 1, 1976, pp. 13–17.

Barnes et al., "Copper–67 Production & Recovery from ZnO Targets" La–Ur–82–90; 6/15/82.

Barnes et al., "Production of $^{67}$Cu at LAMPF" LA–U–R–82–1175; 9/12/82.

*Primary Examiner*—Donald P. Walsh

*Attorney, Agent, or Firm*—William A. Eklund; Paul D. Gaetjens

[57] ABSTRACT

A method of producing carrier-free $^{67}$Cu by proton spallation combined with subsequent chemical separation and purification is disclosed. A target consisting essentially of pressed zinc oxide is irradiated with a high energy, high current proton beam to produce a variety of spallogenic nuclides, including $^{67}$Cu and other copper isotopes. The irradiated target is dissolved in a concentrated acid solution to which a palladium salt is added. In accordance with the preferred method, the spallogenic copper is twice coprecipitated with palladium, once with metallic zinc as the precipitating agent and once with hydrogen sulfide as the precipitating agent. The palladium/copper precipitate is then dissolved in an acid solution and the copper is separated from the palladium by liquid chromatography on an anion exchange resin.

7 Claims, 3 Drawing Figures

METHOD OF PRODUCING $^{67}$CU

This invention is the result of a contract with the Department of Energy (Contract No. W-7405-ENG-36).

BACKGROUND OF THE INVENTION

The invention disclosed herein is generally related to methods for producing radioisotopes for use in diagnostic and experimental medical applications. More particularly, the present invention is related to methods for producing and isolating the short-lived radioactive isotope $^{67}$Cu.

Copper is a biologically important element which is present in low concentrations in virtually all biological systems. Radioactive isotopes of copper are useful for studying the metabolism of copper in such systems. One such isotope is $^{67}$Cu, which is particularly useful because it is easily detected at low concentrations by gamma ray spectroscopy, and also because it has a decay rate which is particularly convenient for use in radiochemical applications. In this regard, the half-life of $^{67}$Cu is 61.9 hours, which is sufficiently long to permit the isotope to be produced, shipped to an end user, and used for its intended purpose before it decays. At the same time, such a half life is sufficiently short that the isotope decays substantially completely over a period of a few weeks, thus avoiding the difficulties ordinarily associated with the disposal of radioactive waste.

Other short-lived radioactive isotopes of copper include $^{64}$Cu, with a half-life of 13 hours, and $^{61}$Cu, with a half-life of 3.3 hours. Each of these isotopes is too short-lived to permit it to be produced and shipped to a distant user.

In medical tracing applications, it is often desirable to use as small an amount of radioactive tracer as possible. This is because it is desirable not to disturb the natural chemical equilibrium of a living biological system, such as would result from injecting a large amount of a chemical element. When the normal equilibrium of a living system is overwhelmed with a large quantity of an element, the natural biological elimination mechanisms operate to collect and excrete the element, such that it cannot be traced in the course of its ordinary metabolism. Consequently, it is desirable to use a radioactive tracer which has a sufficiently high activity to permit the detection and location of very small amounts of the tracer within a biological system. When such a radioactive nuclide is substantially free of stable isotopes of the same element, it is referred to as being carrier-free.

One well known method of producing artificial nuclides utilizes low energy charged particle accelerators. Such accelerators can be used to synthesize various nuclides by inducing the capture of accelerated particles by target nuclides. By such a method, the isotope $^{67}$Cu could conceivably be produced through a (p, 2p) reaction by bombarding $^{68}$Zn with protons; or through a (d, 2p) reaction by bombarding $^{67}$Zn with deuterons; or through a ($\alpha$, 2p) reaction by bombarding $^{65}$Cu with alpha particles. However, none of these reactions is of practical interest, either because of the high cost of the enriched isotope species or a low reaction cross section, or both, and to date there has been no practical method of producing significant amounts of $^{67}$Cu with a low energy charged particle accelerator.

Another technique that has been previously used to produce synthetic nuclides is the double neutron capture method. This method is conducted in the high neutron flux of a nuclear reactor, and uses two successive (n,$\gamma$) reactions. Stable $^{65}$Cu would be used to produce $^{67}$Cu by this method. Such a method is not feasible, however, because the intermediate nuclide, $^{66}$Cu, is unstable, with a 9 minute half-life. Also, this technique would only produce $^{67}$Cu mixed with large amounts of stable copper, thus diminishing its value for medical tracing applications.

$^{67}$Cu has previously been produced by neutron bombardment of $^{67}$Zn in a nuclear reactor. The $^{67}$Zn undergoes a (n,p) reaction to produce $^{67}$Cu directly. More specifically, the $^{67}$Zn captures a neutron to form $^{68}$Zn, which then decays by emission of a proton to give $^{67}$Cu. This method requires the use of isotopically enriched $^{67}$Zn as the starting material, which is very expensive and available only in small quantities. In such a reaction, 100 mg of 97% enriched $^{67}$Zn (purchased at a typical price of approximately $1,000 per gram) is irradiated for approximately 72 hours in a fast neutron flux of $10^{15}$ neutrons/cm$^2$-sec. However, the reaction has a cross-section of approximately 0.82 millibarns, which represents a relatively low reaction probability. Also, the probability of an (n,$\gamma$) reaction in the target $^{67}$Zn, which produces $^{68}$Zn, is much higher than the probability of the (n,p) reaction, with the result that much more $^{68}$Zn than $^{67}$Cu is formed. Thus, the (n,p) reaction has a very low yield, but has nevertheless been the only method previously available for making $^{67}$Cu. The expensive $^{67}$Zn target was essentially consumed in each reaction run, forming unwanted $^{68}$Zn and only small amounts of $^{67}$Cu. In a typical run 12 millicuries of $^{67}$Cu were formed, as opposed to yields on the order of a curie with the method of the present invention described below.

It will be further recognized that the relatively short half-life of $^{67}$Cu, less than three days, requires that any process of producing $^{67}$Cu by a nuclear reaction must be combined with a process of chemical separation and purification that is sufficiently rapid to permit prompt preparation of the $^{67}$Cu in a form suitable for medical use and shipping of the isotope to distant medical facilities.

It has been known for some time that high energy charged particle accelerators are capable of producing various nuclides by spallation reactions. In such a reaction a target nuclide is impacted with high energy particles, which do not combine with the target nuclide as in the case of the low energy particle accelerators mentioned above, but rather decompose the target nuclide by spallation to produce a variety of nuclides which are generally of both lower atomic weight and lower atomic number than that of the target nuclide. However, until recently there have not been available high energy accelerators with sufficient beam current capacity to produce significant quantities of nuclides by spallation reactions. The advent of high current proton accelerators, such as the Meson Physics Facility as the Los Alamos National Laboratory, made it feasible to pursue the production of nuclides such as $^{67}$Cu in significant quantities by proton spallation. At the same time, however, the selection of suitable target materials for this purpose was complicated by certain problems associated with the high current accelerators, particularly the high temperatures generated in the target and the production of significant amounts of radioactive byproducts. Such byproducts hinder the rapid chemical separation of short-lived nuclides after the target is removed from the accelerator.

For example, arsenic and selenium were thought to be feasible target materials for producing $^{67}Cu$, on the basis of their atomic numbers and weights. However, heat calculations and irradiation experience indicated that these elements would be likely to vaporize from any target compound in which they might be incorporated, possibly causing the irradiation container to burst under the high temperature conditions of the target. In this regard, it is noted that the Los Alamos Meson Physics Facility presently produces a beam of protons having an energy of 800 MeV at a current of 700 microamps, which represents a power input into a single target of approximately 10 to 15 kilowatts.

Gallium would also be a feasible target material in view of its atomic number and weight, but it is particularly difficult to separate chemically from the resulting $^{67}Cu$.

Another material which was considered for use as a target in producing $^{67}Cu$ was rubidium bromide. RbBr was considered particularly suitable because both Rb and Br will produce $^{67}Cu$ by proton spallation reactions. However, upon testing RbBr as a target it was found that radioactive gaseous krypton is a significant fragmentation product of the spallation reaction. The production of radio-krypton requires a period of decay prior to target dissolution, with accompanying unacceptable delays in the chemical separation of the short-lived $^{67}Cu$.

SUMMARY OF THE INVENTION

Accordingly, it is the object and purpose of the present invention to provide a method of producing and isolating $^{67}Cu$.

It is also an object of the present invention to provide a method of producing carrier-free $^{67}Cu$, or $^{67}Cu$ which is substantially free of stable isotopes of copper, so that it may be used in very small undiluted amounts in biological applications.

It is another object of the present invention to provide a method of producing $^{67}Cu$ by a proton spallation reaction combined with a chemical separation process which is sufficiently fast to permit preparation of the $^{67}Cu$ for medical uses and shipping of the isotope to medical facilities at distant locations.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the methods particularly pointed out in the appended claims.

To achieve the foregoing and other objects, and in accordance with the purposes of the present invention as embodied and broadly described herein, the method of the present invention comprises the steps of irradiating a target of zinc oxide with a beam of high energy protons to produce spallogenic reaction products including $^{67}Cu$, followed by chemical separation and purification of the spallogenic copper by ion exchange chromatography. For several reasons, this method constitutes a substantial improvement over the previously known method of producing $^{67}Cu$ described above. For example, expensive isotopically enriched zinc is not required or even preferred. Nevertheless, the net yield of $^{67}Cu$ by the method of the present invention is on the order of a hundred times the yield obtained with the previously used method mentioned above. These factors significantly reduce the net cost of production over that of the prior art method.

Zinc oxide is employed as the target material in the present method because it is of the appropriate atomic number to produce significant amounts of $^{67}Cu$ by proton spallation, and further because it is a material which is sufficiently refractory to withstand the high temperature conditions existing during irradiation with a high energy proton beam having a substantial beam current. Additionally, zinc oxide does not produce detectable amounts of radioactive krypton or other gaseous isotopes, which would impede and delay the subsequent chemical separation and purification process.

Another advantage of this method is that the spallation of naturally occuring zinc results in the production of several isotopes of copper, including $^{61}Cu$, $^{64}Cu$ and $^{67}Cu$, all of which are relatively short-lived radioactive isotopes. Of these three isotopes, $^{67}Cu$ is the longest-lived, with a half-life of 62 hours. Only negligible amounts of stable Cu are produced, thus permitting the use of the spallogenic copper in no-carrier-added tracing applications.

Ion exchange chromatography is employed to separate and purify the spallogenic copper because it is a fast and efficient method which permits the $^{67}Cu$ to be shipped within hours after production. As a result the isotope can be shipped to distant medical facilities before its activity is substantially diminished by radioactive decay. In the preferred embodiment of the method the ZnO target is dissolved in acid solution and a palladium salt is added to the solution. The spallogenic copper is then isolated by precipitation of both the copper and palladium by adding hydrogen sulfide and metallic zinc to the aqueous solution, followed by liquid chromatography on an anion exchange column to separate the copper from the palladium and other contaminants.

In accordance with an alternative separation method, purification of the $^{67}Cu$ is accomplished by a three-stage chromatographic process. In accordance with this method, the irradiated ZnO target is dissolved in a concentrated acid solution, to which palladium chloride and finely divided metallic zinc are added in sequence. The zinc reduces the $Pd^{+2}$ to the metal, which precipitates out and scavenges the spallogenic copper from the solution in the process. In this regard, it is noted that only extremely small amounts of spallogenic copper are produced by the proton irradiation of the target, on the order of a microgram or less, thus requiring resort to techniques for quantitatively extracting the copper without introducing contaminants, particularly stable copper. The palladium/copper mixture is then redissolved and passed successively through a cation exchange resin, an anion exchange resin, and another cation exchange resin, using an acidified acetone/water solvent and eluent in the latter step.

These and other aspects of the invention are more fully set forth in the following detailed description of the invention.

BRIEF DESCRIPTION OF THE DRAWINGS

The accompanying drawings, which are incorporated in and form a part of the specification, illustrate preferred embodiments of the method of the present invention and, together with the following detailed description, serve to explain the principles of the invention. In the drawings.

DETAILED DESCRIPTION OF THE PREFERRED EMBODIMENT

In accordance with the preferred embodiment of the method of the present invention, a target is prepared by pressing approximately 90 grams of powdered zinc oxide into a solid disc contained inside a high purity aluminum ring. High purity aluminum is used to avoid the presence of copper contaminants in the aluminum, which would migrate into the target during irradiation and contaminate the spallogenic copper formed from the ZnO. The target is placed in an aluminum target enclosure for introduction into the target region of the linear accelerator.

Figure 1:
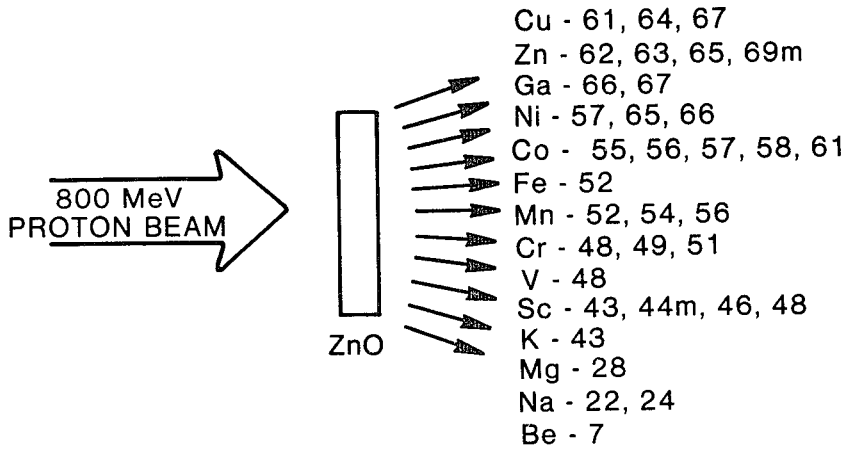
FIG. 1 is a schematic illustration of the production of the various spallation products obtained by the irradiation of a zinc oxide target with high energy protons.

The ZnO target is irradiated with a proton beam having an energy of approximately 800 MeV and a beam current on the order of 300 microamperes, for a period on the order of 60–70 hours. The spallation cross section of the ZnO target for $^{67}Cu$ is approximately 5.35 millibarns. Under such conditions, an amount of $^{67}Cu$ on the order of 1.0 curie (approximately 1.3 micrograms) is formed, together with approximately 34 other identifiable nuclides, which are presented in FIG. 1. The only other isotopes of copper which are produced in measurable quantities are the short-lived isotopes $^{64}Cu$ and $^{61}Cu$.

Figure 2:
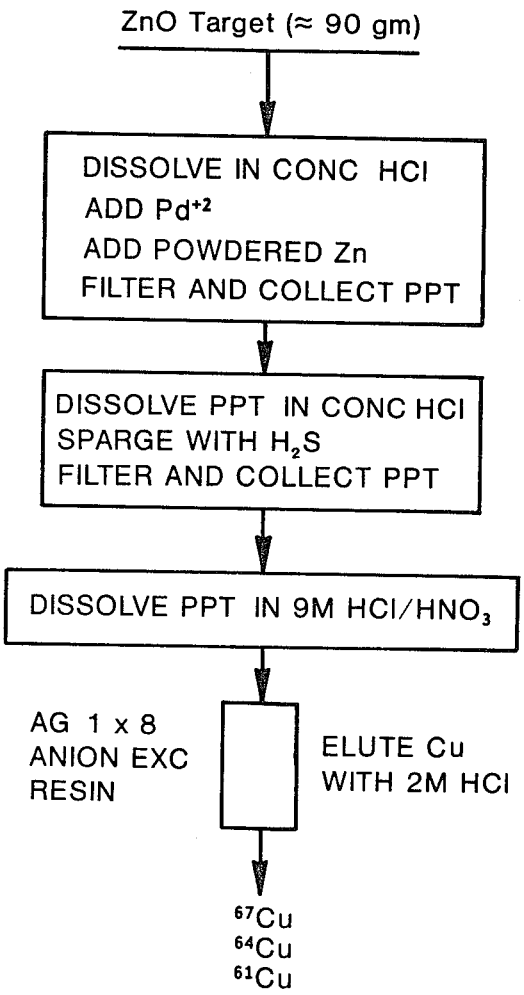
FIG. 2 is a schematic flow chart illustrating the preferred method of separating and purifying the spallogenic copper isotopes produced by the irradiation of the zinc oxide target.

In accordance with the preferred method of chemical separation, which is illustrated schematically in FIG. 2, the irradiated ZnO target is removed from the aluminum ring and dissolved in a concentrated HCl solution. To this acid solution is added approximately 20 milligrams of $Pd^{+2}$ (added as 2.5 cc of palladium chloride solution containing 8.5 mg $Pd^{+2}$/cc). Approximately one-half to two grams of finely powdered metallic zinc are then added to the acid solution. The zinc is oxidized to $Zn^{+2}$, which reduces the $Pd^{+2}$ to metallic palladium and also reduces the spallogenic $Cu^{+2}$ in solution to metallic copper. The metallic palladium precipitates as a finely divided solid and quantitatively scavenges from solution the spallogenic copper. The metal precipitate is then redissolved in an acid solution and the palladium and copper are once again precipitated, this time by sparging the acid solution with gaseous hydrogen sulfide. The sulfide precipitate is then dissolved once again in an acid solution, and the palladium and copper in solution are separated by chromatography on an anion exchange column.

Figure 3:
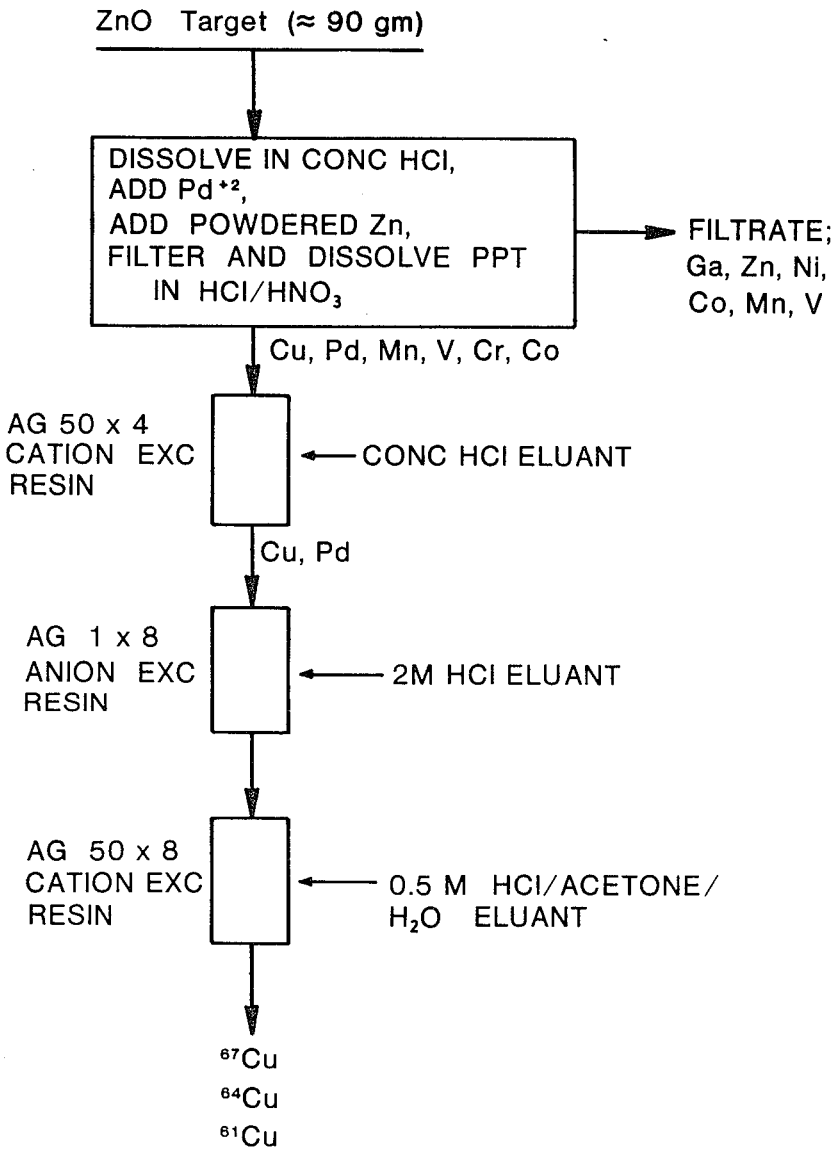
FIG. 3 is a schematic flow chart illustrating an alternative method of separating and purifying the copper isotopes.

In an alternative variation of the chemical separation step of the method, the palladium is precipitated by the introduction of powdered zinc as above, and the precipitated palladium/copper mixture is subsequently passed through a series of three ion exchange columns, as illustrated in FIG. 3.

In accordance with the latter alternative method, the mixture of metallic palladium and copper, which also contains traces of spallogenic cobalt, manganese and vanadium, is collected by filtration and dissolved in an acid solution consisting of approximately 9 ml concentrated HCl and 1 ml concentrated $HNO_3$. This solution is passed through a cation exchange resin column, preferably consisting of purified Dowex AG (Analytical Grade) 50×4 (sulfonic acid resin type column), which is commercially available from Bio-Rad, Inc. of Richmond, Calif. This column operates to capture any gallium that may be present with the spallogenic copper. In this regard, it is noted that $^{67}Ga$, which is a spallogenic reaction product, has a gamma emission spectrum which is nearly identical to that of $^{67}Cu$, thus making it difficult to detect in the initial stages of chemical separation. The cation column also collects $^{51}Cr$, which is also present in trace amounts in the reaction products.

The eluate solution, which contains Cu as well as Pd in essentially concentrated HCl, is introduced untreated into a second column which is an anion exchange column, and which preferably consists of purified Dowex AG 1×8 quaternary amine resin, a strong base anion resin. The $Cu^{+2}$, together with the $Pd^{+2}$, is initially bound to the anion exchange resin. The $Cu^{+2}$ is then selectively eluted from the column with 2M HCl, leaving behind the $Pd^{+2}$ as a palladium chloro complex.

The eluted solution, containing $Cu^{+2}$ and having a volume on the order of 15 ml, is evaporated to dryness and the residue subsequently dissolved in a solution consisting of 80% (by volume) acetone and 20% water, acidified to 0.1 molar HCl. This solution is then passed through a third column containing a Bio-Rad Dowex AG 50×8 cation exchange resin. The Cu is absorbed on this column initially, together with any $Co^{+2}$ or $Mn^{+2}$ that may be present. The $Cu^{+2}$ is then selectively eluted with an acetone/water solution acidified to 0.5M HCl. The use of this third column to remove traces of Mn and Co is not mandatory to the practice of the method, but is preferred when the $^{67}Cu$ is to be used over a period longer than several half-lives, since in such circumstances the activities of trace amounts of spallogenic radioactive Co and Mn isotopes become large relative to the activity of the $^{67}Cu$ and thereby interfere with measurement of $^{67}Cu$ gamma ray emissions.

The 0.5M HCl/acetone/water solution containing the spallogenic $^{67}Cu$ is sufficiently pure for use in medical applications. However, if desired, this solution may be evaporated to dryness and the residue redissolved in 0.1M HCl, which renders the solution more desirable for some medical applications.

The yield of $^{67}Cu$ by this version of the method is on the order of 50% of the spallogenic $^{67}Cu$ originally produced. The only impurities that have been detected are trace amounts of inactive Zn and inactive Cu. The spallogenic Cu includes some $^{64}Cu$, which has a half-life of 12.7 hours and which largely decays by the time the $^{67}Cu$-bearing solution is shipped and prepared for use. Also present in the spallogenic Cu is $^{61}Cu$, which decays even faster with its half-life of 3.3 hours.

EXAMPLE 1

In an actual demonstration of the method, a spallation target consisting of 79.2 grams of powdered zinc oxide was bombarded with 800 MeV protons for a period of 93.4 hours in the linear accelerator of the Los Alamos Meson Physics Facility. The beam current averaged 423 microamps and resulted in a total integrated irradiation of 39,531 microamp-hours. A yield of 3.11 curies of $^{67}Cu$ was obtained, using the alternative separation process described above. Also obtained were 10.0 curies of $^{64}Cu$ and an undetermined amount of $^{61}Cu$. Additionally, it was determined that 3.4 curies of $^{62}Zn$ and 0.96 curie of $^{48}V$ were produced, as well as other unidentified nuclides.

EXAMPLE 2

In another demonstration of the method, also using the alternative 3-column separation process, a target consisting of 75.7 grams of zinc oxide was irradiated with 800 MeV protons for a period of 23.9 hours. The beam current was approximately 386 microamps and provided an integrated irradiation of 9,219 microamp-hours. A yield of 1.0 curie of $^{67}Cu$ was obtained. Also obtained were 9.4 curies of $^{64}Cu$, 11.9 curies of $^{61}Cu$, 2.5 curies of $^{62}Zn$ and 0.22 curie of $^{48}V$.

EXAMPLE 3

In another demonstration, a target consisting of 73.2 grams of zinc oxide was irradiated with a total irradiation of 15,643 microamp-hours. The target was then dissolved in 160 cc of concentrated HCl. To this solution was added 2.5 cc of a $PdCl_2$ solution containing 8.5 mg/cc Pd. 0.5 gm of zinc dust was added to effect reduction of the Pd and spallogenic Cu in solution. The reduced metal was collected by filtration and dissolved in a solution consisting of 10 cc concentrated HCl and 1 cc concentrated $HNO_3$. The resulting solution was heated and stirred and sparged with hydrogen sulfide for several minutes. The resulting precipitate was collected by filtration and dissolved in a $HCl/HNO_3$ solution as described above. This solution was diluted with 9M HCl, which was used to rinse the filter, to obtain a solution approximately 9M in HCl.

The Cu-bearing 9M HCl solution was added to an AG 1×8 anion exchange column. The column was washed with 2 to 3 column volumes of 9M HCl. The copper was then eluted from the column with 2M HCl, leaving the Pd behind on the column. The resulting solution was determined to contain 201 millicuries of $^{67}Cu$.

The foregoing descriptions of alternative preferred embodiments of the method of the present invention have been presented for purposes of illustration and description. They are not intended to be exhaustive or to limit the invention to the precise forms disclosed, and obviously many modifications and variations are possible in light of the above teaching. The particular embodiment described and illustrated were selected in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A method of producing $^{67}Cu$ by proton spallation, comprising the steps of irradiating a target consisting essentially of zinc oxide with a beam of protons having an energy of approximately 800 MeV to produce spallogenic reaction products including $^{67}Cu$, and subsequently separating said $^{67}Cu$ from said reaction products by ion exchange chromatography.

2. The method defined in claim 1 wherein the separation of the $^{67}Cu$ by ion exchange chromatography comprises the steps of dissolving the irradiated target in a first concentrated acid solution, adding a palladium salt to said first concentrated acid solution, adding powdered metallic zinc to said first concentrated acid solution to induce precipitation of a first precipitate of palladium and spallogenic copper, dissolving said first precipitate of palladium and spallogenic copper in a second concentrated acid solution, sparging said second concentrated acid solution with gaseous hydrogen sulfide to induce precipitation of a second precipitate of palladium and spallogenic copper, dissolving said second precipitate of palladium and spallogenic copper in a third concentrated acid solution, and separating the palladium from the spallogenic copper by loading said third concentrated acid solution into an anion exchange resin, washing the column with a strong acid solution to remove the palladium, and subsequently eluting the spallogenic copper from the column by elution with a relatively weaker acid solution.

3. The method defined in claim 2 wherein said third concentrated acid solution comprises an approximately 9 molar solution of HCl and $HNO_3$ in a ratio of approximately nine to one, and wherein said relatively weaker acid solution comprises approximately 2 molar HCl.

4. The method defined in claim 2 wherein said palladium salt is added as a solution of palladium chloride.

5. The method defined in claim 1 wherein the separation of the $^{67}Cu$ by ion exchange chromatography comprises the steps of dissolving the irradiated target in a first concentrated acid solution, adding a palladium salt to said first concentrated acid solution, adding powdered metallic zinc to said first concentrated acid solution to induce precipitation of metallic palladium and metallic spallogenic copper, dissolving the precipitated palladium and spallogenic copper in a second concentrated acid solution, loading the second concentrated acid solution into a first cation exchange resin, eluting said first cation exchange column with a strong acid solution to elute palladium and copper, loading the eluate containing palladium and copper from the first cation exchange column into an anion exchange column and eluting said anion exchange column with a relatively weak acid solution to elute the spallogenic copper from said cation exchange column, loading the eluate solution containing the spallogenic copper from said cation exchange column into a second anion exchange column, and eluting said second anion exchange column with an acetone/water HCl solution to obtain an eluate solution containing said spallogenic copper.

6. The method of claim 5 wherin said acetone/water HCl solution consists essentially of 80% (by volume) acetone and 20% (by volume) water, acidified to 0.5 molar HCl.

7. The method defined in claim 5 wherein the eluate obtained from said cation exchange column is evaporated to dryness and the residue dissolved in an acetone/water solution consisting essentially of 80% acetone and 20% water (by volume) and acidified to 0.1M HCl, and wherein said acetone/water solution is passed through said second anion exchange column and eluted with 0.5M HCl solution of 80% acetone and 20% water.

* * * * *